US010443334B2

(12) United States Patent
Vuyk, Jr.

(10) Patent No.: US 10,443,334 B2
(45) Date of Patent: Oct. 15, 2019

(54) CORRECTION FOR DRILL PIPE COMPRESSION

(71) Applicant: Weatherford Technology Holdings LLC, Houston, TX (US)

(72) Inventor: Adrian Vuyk, Jr., Cypress, TX (US)

(73) Assignee: Weatherford Technology Holdings LLC, Houston, TX (US)

( * ) Notice: Subject to any disclaimer, the term of this patent is extended or adjusted under 35 U.S.C. 154(b) by 300 days.

(21) Appl. No.: 15/599,683

(22) Filed: May 19, 2017

(65) Prior Publication Data

US 2018/0334872 A1 Nov. 22, 2018

(51) Int. Cl.

| | |
|---|---|
| ***E21B 29/06*** | (2006.01) |
| ***E21B 47/09*** | (2012.01) |
| ***E21B 7/06*** | (2006.01) |
| ***E21B 41/00*** | (2006.01) |
| ***E21B 44/00*** | (2006.01) |
| ***E21B 44/02*** | (2006.01) |

(52) U.S. Cl.

CPC ..... *E21B 29/06* (2013.01); *E21B 7/061* (2013.01); *E21B 41/0035* (2013.01); *E21B 44/00* (2013.01); *E21B 44/02* (2013.01); *E21B 47/09* (2013.01)

(58) Field of Classification Search

CPC ..... E21B 47/09; E21B 29/06

See application file for complete search history.

(56) References Cited

U.S. PATENT DOCUMENTS

| | | | |
|---|---|---|---|
| 5,844,132 | A | 12/1998 | Fabret et al. |
| 7,306,054 | B2 | 12/2007 | Hutchinson |
| 2014/0196949 | A1 | 7/2014 | Hareland et al. |
| 2014/0209383 | A1 | 7/2014 | Vuyk, Jr. |
| 2015/0275647 | A1 | 10/2015 | Rolong et al. |

*Primary Examiner* — Robert E Fuller

(74) *Attorney, Agent, or Firm* — Patterson + Sheridan, LLP

(57) ABSTRACT

Methods, apparatus, and systems are provided for correcting, or at least adjusting, for drill pipe compression in a downhole operation in a wellbore. An exemplary method includes obtaining an indication of a first displacement, from a base position, of a first portion of a drill string due to a first force being applied to the first portion of the drill string and a second portion of the drill string being stationary; obtaining an indication of the first force; obtaining an indication of a second displacement, from the base position, of the first portion of the drill string due to a second force being applied to the first portion of the drill string while performing a downhole operation; obtaining an indication of the second force; and determining a displacement of the second portion of the drill string, based on the first displacement, the second displacement, the first force, and the second force.

30 Claims, 6 Drawing Sheets

CORRECTION FOR DRILL PIPE COMPRESSION

BACKGROUND

Field

Aspects of the present disclosure generally relate to downhole operations, and more particularly to techniques for correcting for drill pipe compression in downhole operation in a wellbore without using downhole subs.

Description of the Related Art

In well construction and completion operations, a wellbore for accessing hydrocarbon-bearing (e.g., crude oil and/or natural gas) formations is formed by using drilling. Drilling is accomplished by rotating a drill bit that is mounted on the end of a drill string. To drill within the wellbore to a predetermined depth, the drill string is often rotated by a top drive or rotary table on a surface platform or rig. Additionally or alternatively, the drill string may be rotated by a downhole motor mounted towards the lower end of the drill string. After drilling to a predetermined depth, the drill string and drill bit are removed, and a section of casing is lowered into the wellbore. Multiple sections of casing may form a string of casing. An annulus is thus formed between the string of casing and the formation. A cementing operation is then conducted in order to fill the annulus with cement. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

Sidetrack drilling is a process which allows an operator to drill a primary wellbore, and then drill an angled lateral wellbore off of the primary wellbore at a chosen depth. Generally, the primary wellbore is first cased with a string of casing and cemented. Then, a tool known as a whipstock is attached to the drill string and lowered in the casing to the depth where deflection is desired. The whipstock is specially configured to divert mills. A mill (e.g., a milling bit) is attached to the drill string above the whipstock, and, after the whipstock is set, the mill is rotated by either the top drive or rotary table to mill (e.g., cut) a hole in the casing. Alternatively, the mill may be attached to the drill string after the whipstock is set in the wellbore. After the mill has milled a sufficiently large hole penetrating the casing, the mill is removed from the drill string, and a drill bit is attached to the drill string and used to continue drilling in the direction of the desired angled lateral wellbore. If the mill is removed before the hole in the casing is sufficiently large or has fully penetrated the casing, the drill bit may not be able to begin drilling in the desired formation. The drill bit may then be removed from the drill string and the mill reattached to enlarge or otherwise complete the hole in the casing. The process of detaching the drill bit, attaching the mill, removing the mill, and attaching the drill bit requires time and raises expenses associated with drilling the angled lateral wellbore.

Other downhole operations, such as installing liner hangers, cementing components, or fishing for tools may also involve accurately locating a bottom of a drill string or a bottom hole assembly (BHA), so as to assure that the downhole operation is completed successfully.

There is therefore a need for techniques and apparatus to accurately control downhole operations, such as milling casing exits downhole in a borehole.

SUMMARY OF THE INVENTION

Aspects of the present disclosure generally relate to controlling downhole operations, such as milling casing exits downhole in a borehole.

One aspect of the present disclosure is a method for controlling a downhole operation in a wellbore. The method generally includes obtaining an indication of a first displacement, from a base position, of a first portion of a drill string due to a first force being applied to the first portion of the drill string and a second portion of the drill string being stationary; obtaining an indication of the first force; obtaining an indication of a second displacement, from the base position, of the first portion of the drill string due to a second force being applied to the first portion of the drill string while performing the downhole operation; obtaining an indication of the second force; and determining a displacement of the second portion of the drill string, based on the first displacement, the second displacement, the first force, and the second force.

Another aspect of the present disclosure is an apparatus for controlling a downhole operation in a wellbore. The apparatus generally includes a processing system configured to obtain an indication of a first displacement, from a base position, of a first portion of a drill string due to a first force being applied to the first portion of the drill string and a second portion of the drill string being stationary; to obtain an indication of the first force; to obtain an indication of a second displacement, from the base position, of the first portion of the drill string due to a second force being applied to the first portion of the drill string while performing the downhole operation; to obtain an indication of the second force; and to determine a displacement of the second portion of the drill string, based on the first displacement, the second displacement, the first force, and the second force; and a memory coupled with the processing system.

Yet another aspect of the present disclosure is a non-transitory computer-readable medium containing a program which, when executed by a processing system, causes the processing system to perform operations. The operations generally include obtaining an indication of a first displacement, from a base position, of a first portion of a drill string due to a first force being applied to the first portion of the drill string and a second portion of the drill string being stationary; obtaining an indication of the first force; obtaining an indication of a second displacement, from the base position, of the first portion of the drill string due to a second force being applied to the first portion of the drill string while performing a downhole operation; obtaining an indication of the second force; and determining a displacement of the second portion of the drill string, based on the first displacement, the second displacement, the first force, and the second force.

BRIEF DESCRIPTION OF THE DRAWINGS

So that the manner in which the above-recited features of the present disclosure can be understood in detail, a more particular description of the disclosure, briefly summarized above, may be had by reference to aspects, some of which are illustrated in the appended drawings. It is to be noted, however, that the appended drawings illustrate only typical aspects of this disclosure and are therefore not to be considered limiting of its scope, for the disclosure may admit to other equally effective aspects.

DETAILED DESCRIPTION

Figure 1:
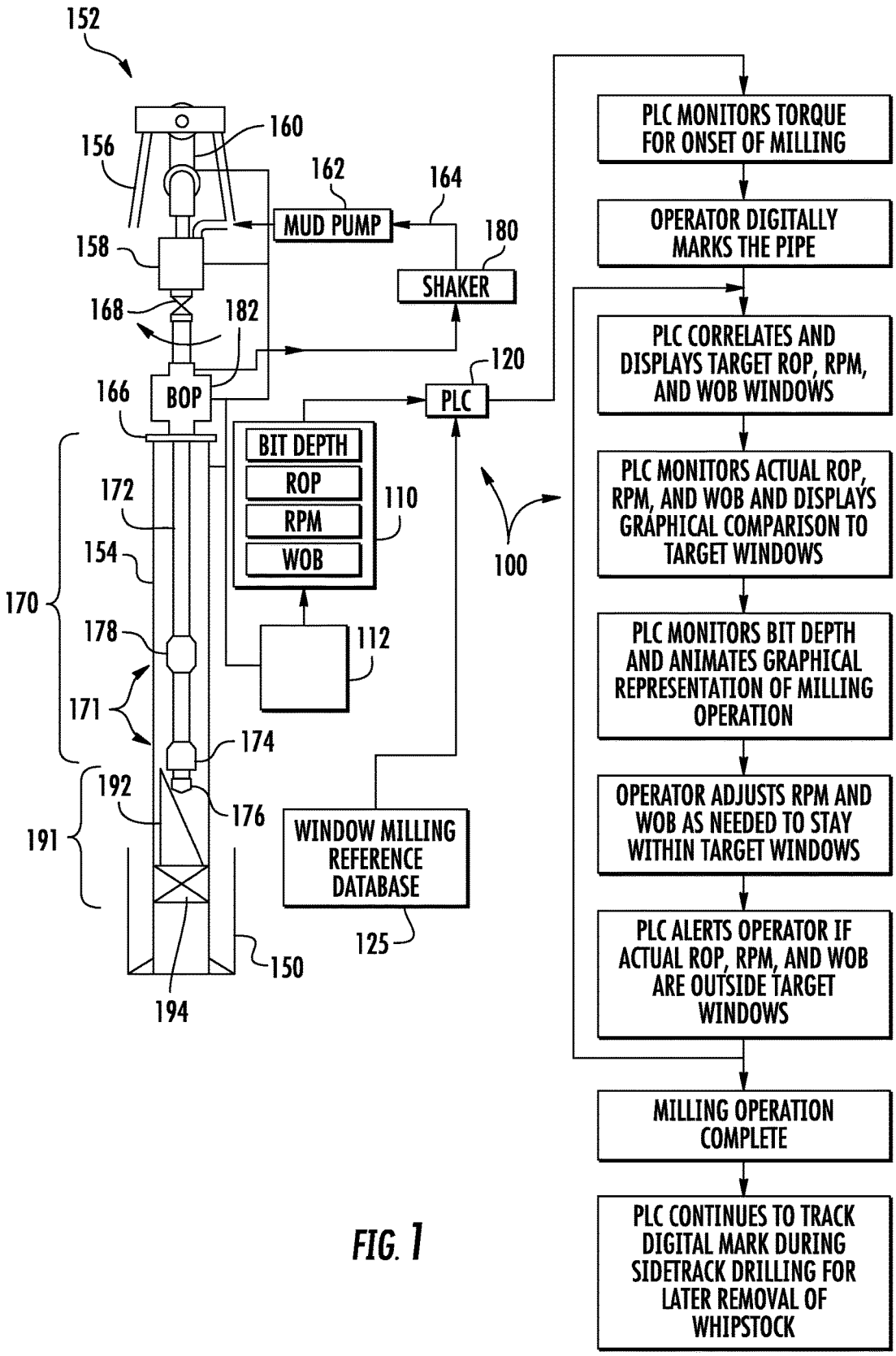
FIG. 1 illustrates an exemplary control system, according to certain aspects of the present disclosure.

Aspects of the present disclosure provide techniques that may improve control of downhole operations within a wellbore. For example, the techniques may allow improved accuracy of measurements of penetration of a casing and rate of penetration (ROP) of the casing, when controlling a casing milling operation. Aspects of the present disclosure may enable a 100% success rate on single-trip casing milling operations.

That is, casing milling operations using aspects of the present disclosure may be successful with a first milling of the casing 100% of the time, rather than occasionally (e.g., 19%) requiring the milling bit to be attached to the drill string and used to mill the casing at least one more time, as in previously known techniques.

As used herein, the term "exemplary" means "serving as an example, instance, or illustration," and should not necessarily be construed as preferred or advantageous over other implementations. The detailed description includes specific details for the purpose of providing a thorough understanding of the implementations. In some instances, some devices are shown in block diagram form.

As used herein, "weight" of an object generally refers to a downward force due to gravity, equal to the product of the object's mass and the value of gravitational acceleration. If the entire weight of a first object is being supported by a second object (e.g., the first object is at rest on the second object), then the entire weight of the first object is generally applied as a downward force on the second object. The second object generally applies an upward force on the first object that is equal in magnitude to the downward force (i.e., the entire weight of the first object). If a portion of the weight of the first object is being supported by the second object, then the portion of the weight is generally applied as a downward force on the second object, and the second object generally applies an upward force on the first object that is equal in magnitude to the downward force (i.e., the portion of the weight of the first object).

Friction between objects in the well bore and the wellbore wall further diminish the transfer of forces from the distal end of the drill string where the work is being performed to the proximal end (e.g., proximal to the drilling rig), where the sensors are most readily located. This is exacerbated in long horizontal sections and wellbores that are not drilled along a straight trajectory. Further, the fluids may not be uniform, and the relative density of the drill string components and the downhole fluids will create a buoyant effect on the forces that translate from the distal to the proximal end of the work string, as well. The solution is typically to record the "up weight" and the "down weight" and use that as the aggregate correction between applied weight at surface and the force needed to make the work string move. Unfortunately, this renders the actual friction force as an unknown force. To solve this, the industry has developed and deployed industry tools to measure the forces near the distal end of the work string and transmit this data back to surface. The technology described herein may serve to eliminate the need for this downhole telemetry technology in the special circumstance when an absolute bottomhole reference is available and all forces are determinate in the aggregate.

While aspects of the present disclosure described herein focus on casing milling operations, the present disclosure is not so limited, and aspects of the present disclosure may improve control of other downhole operations, including, for example, installation of liner hangers and cementing of components in a borehole or retrieval of an object (fish) in a wellbore (called fishing).

FIG. 1 is a schematic diagram of a control system 100, according to one aspect of the present disclosure. The control system may be part of a milling system. A primary wellbore 150 has been drilled using a drilling rig 152. A casing string 154 has been installed in the primary wellbore 150 by being hung from a wellhead 166 and cemented (not shown in FIG. 1, see FIG. 2A) in place. Once the casing string 154 has been deployed and cemented, a mill string 170 with a bottom hole assembly (BHA) 171 and a deployment string 172 of drill pipe may be deployed into the primary wellbore 150 for a sidetrack milling operation.

As used herein, "mill string," "drill string," "deployment string," and "work string" all refer to an assemblage of one or more pieces of drill pipe and tools that may be lowered into a wellbore and used to deploy the tools into the wellbore. Thus, "mill string," "drill string," "deployment string," and "work string" are, as used in the present disclosure, synonymous and are used interchangeably.

The drilling rig 152 may be deployed on land or offshore. If the primary wellbore 150 is subsea, then the drilling rig may be a mobile offshore drilling unit, such as a drillship or semisubmersible. The drilling rig 152 may include a derrick 156. The drilling rig 152 may further include draw works 160 for supporting a top drive 158. The top drive 158 may in turn support and rotate the mill string 170. Alternatively, a Kelly and rotary table (not shown) may be used to rotate the mill string 170 instead of the top drive. The drilling rig 152 may further include a mud pump 162 operable to pump milling fluid 164 from of a pit or tank (not shown), through a standpipe and Kelly hose to the top drive 158. The milling fluid 164 may include a base liquid. The base liquid may be refined oil, water, brine, or an emulsion of water and oil. The milling fluid 164 may further include solids dissolved or suspended in the base liquid, such as organophilic clay, lignite, and/or asphalt, thereby forming a mud.

When a mill string 170 is deployed in the wellbore 150, the weight of the BHA 171 and deployment string 172 may be supported by the draw works 160 via the top drive 158. The mill string 170 may be lowered in the wellbore 150 by means of a "slacking-off" operation by the draw works 160, which involves allowing portions of the draw works 160 to move downward, in turn allowing the mill string to move downward. If a portion of the mill string 170 is held stationary (e.g., a BHA has contacted an object in the wellbore), then a slacking-off operation may result in a portion of the weight of the BHA 171 and the deployment string 172 being supported by the portion of the mill string 170 that is being held stationary. The change in the weight of the mill string 170 being supported by the draw works 160 may be detected and/or measured by sensors, as described below.

The drilling rig 152 may further include a control room (e.g., a dog house) (not shown) having a rig controller 110, such as a server, in communication with an array 112 of sensors for monitoring the milling operation. The array 112 may include one or more of: a mud pump stroke counter (Pump Strokes), a hook load cell (Hook Ld), a hook (and/or draw works) position sensor (Hook Pos), a standpipe pressure (SPP) sensor, a wellhead pressure (WHP) sensor, a torque sub/cell (Torque), a turns (top drive or rotary table) counter (Turns), and a pipe tally (Tally). From the sensor measurements and values input by an operator, the rig controller 110 may calculate additional operational parameters, such as a bit (or bottom hole assembly (BHA)) depth (measured and vertical), flow rate, rate of penetration (ROP), rotational speed (in rotations per minute (RPM)) of the mill string 170, and weight-on-bit (WOB). Alternatively, one or more of these additional parameters may be measured directly by a sensor in the array 112 or calculated by another device or process. The rig controller 110 may also have one or more wellbore parameters stored, such as bottom hole depth (measured and vertical).

The milling fluid 164 may flow from the standpipe and into the mill string 170 via a swivel 168. The milling fluid 164 may be pumped down through the mill string 170 and exit one or more of a lead mill 174 and a pilot mill 176, where the fluid may circulate cuttings (e.g., cuttings cut from the casing by the mill) away from the mill and return the cuttings up an annulus formed between an inner surface of the casing string 154 and an outer surface of the mill string 170. The milling fluid 164 and cuttings (collectively, returns) may flow through the annulus to the wellhead 166 and be discharged to a primary returns line (not shown). Alternatively, a variable choke and rotating control head may be used to exert backpressure on the annulus during the milling operation. The returns may then be processed by a shale shaker 180 to separate the cuttings from the milling fluid 164. One or more blowout preventers (BOP) 182 may also be fastened to the wellhead 166. The mill string 170 may include a deployment string 172, such as joints of drill pipe screwed together, and a bottom hole assembly (BHA) 171. Alternatively, the deployment string may be coiled tubing instead of the drill pipe.

A deflector 191 may be deployed in the casing as part of the sidetrack drilling operation. The deflector 191 may include a whipstock 192 and an anchor 194. The anchor 194 may or may not include a packer for sealing. The deflector 191 may be connected in a releasable manner (e.g., by one or more connectors or fasteners that may be sheared off in a whipstock setting operation) to the BHA 171 for deployment so that the milling operation may be performed in one trip. That is, the deflector 191 may be attached to the BHA 171 until the deflector is set, and then milling of the casing may begin without removing the deployment string 172 (e.g., to attach mills of the BHA 171).

The anchor 194 may be mechanically and/or hydraulically actuated to engage the casing string 154. The whipstock 192 may be connected to the anchor 194 in a releasable manner, such that the whipstock may be retrieved, an extension (not shown) added to the whipstock, and then the whipstock may be reconnected to the anchor for milling a second window (not shown). Alternatively, the anchor and/or the whipstock may be set in one or more separate trips.

The BHA 171 may include a lead mill 174, a pilot mill 176, drill collars, a trail (i.e., secondary or flex) mill 178, measurement while drilling (MWD) sensors (not shown), logging while drilling (LWD) sensors (not shown), and a float valve (to prevent backflow of fluid from the annulus). The deployment string 172 may also include one or more centralizers (not shown) spaced at intervals, and/or the BHA 171 may include one or more stabilizers. The lead mill 174, pilot mill 176, and trail mill 178 may be rotated from the surface by the rotary table or top drive 158 and/or rotated by a drilling motor (not shown) located downhole. Additionally or alternatively, the BHA may include an orienter (not shown).

The control system 100 may include a milling server 120 that may include a programmable logic controller (PLC) that may be implemented as software. Additionally or alternatively, the PLC may be implemented on one or more computers, such as the rig controller 110 or a laptop. The software may be loaded on to the computer(s) from a computer-readable medium, such as a compact disc or a solid state drive. The computers may each include a central processing unit, memory, and an operator interface. The operator interface may include a keyboard, a monitor, and/or a pointing device, such as a mouse or trackpad. Alternatively or additionally, the operator interface may include a touchscreen. The milling server 120 may communicate with the rig controller and other computers via a network. The network may allow the milling server 120 to receive one or more of the rig sensor measurements, the operational parameters, and the wellbore parameters from the rig controller 110 and/or the array 112 of sensors.

The control system 100 may further include a window milling reference database 125. The database 125 may be loaded locally on the milling server 120 and/or accessed (or updated) from a master version, possibly via the Internet and/or an intranet. The database 125 may include references to locations of known or expected events during a window milling operation, such as one or more of: beginning of cutting for each mill, beginning of cutout for each mill, maximum deflection, start and end of a whipstock retrieval slot 212 (see FIG. 2A) that may also include an end of a retrieval lug, start, middle, and end of core point 220 (see FIG. 2B), and a kickoff point 230 (see FIG. 2C). The references to the locations may be distances from one or more reference points, such as a top 210 (see FIG. 2A) of the whipstock. The events may be used to divide the window milling operation into two or more regions, such as a cutout region, a maximum deflection region, a retrieval slot region, a core point region, and a kickoff region. The database 125 may include a set of locations for each of various casing sizes and/or weights.

The database 125 may also include minimum and maximum target values of one or more milling parameters, such as ROP, RPM, and/or WOB, for each region or each event. The target values may be derived from calculations or may be based on observations of milling data from the current milling operation or a previously completed milling operation. For example, the database 125 may include a first minimum and maximum ROP for the cutout region, a second minimum and maximum ROP for the maximum deflection region, a third minimum and maximum ROP for the core point region, and a fourth minimum and maximum ROP for the kickoff region. The target values of one or more of the milling parameters may be predetermined or may vary depending on values measured during the milling process. The target values of one or more the milling parameters may be constant or may vary based on a particular casing size or weight (only one set of target values shown for each parameter). If the target values of a particular milling parameter vary with casing size and/or weight, then the database may include a set of target values for the parameter for each casing size and/or weight. The database 125 may also include predetermined comments based on previous experience for one or more particular regions or events. Alternatively, the database 125 may only include a target value for one or more of the milling parameters instead of a minimum and maximum. Alternatively, the database may include any combination of minimum and maximum target values for some milling parameters and single target values for other milling parameters.

As used herein, weight-on-bit (WOB) generally refers to a portion of the weight of the drill string that is being supported by a bit or other bottom hole assembly (BHA). That is, when a BHA is being lowered into a wellbore, the entire weight of the drill string and the BHA is initially supported by a top drive or other items on the drilling rig until the BHA encounters an object in the wellbore (e.g., a whipstock or the earth at the bottom of the wellbore). The entirety of the drill string may be in tension before the BHA encounters the object. Once the BHA is in contact with the object, if a slacking-off operation is performed at the drilling rig, the BHA at the bottom of the drill string bears a portion of the weight of the drill string, resulting in less upward force being applied at the top of the drill string (e.g., by the top drive). When the BHA is supporting a portion of the weight of the drill string, that portion of the weight of the drill string may be referred to as weight-on-bit.

One or more instruments may measure and report a weight of the drill string that is being supported by the drilling rig (e.g., by the top drive). When the BHA is supporting a portion of the weight of the drill string, the instrument(s) reporting the weight of the drill string being supported by the drilling rig may report a reduction in the weight being supported by the drilling rig. The reduction in the weight supported by the drilling rig may closely approximate (or equal) the weight-on-bit, and the reduction in the weight supported by the drilling rig may be referred to as surface weight-on-bit. Surface weight-on-bit and downhole weight-on-bit generally are not the same, due to buoyancy and friction forces, for example.

Figure 2A:
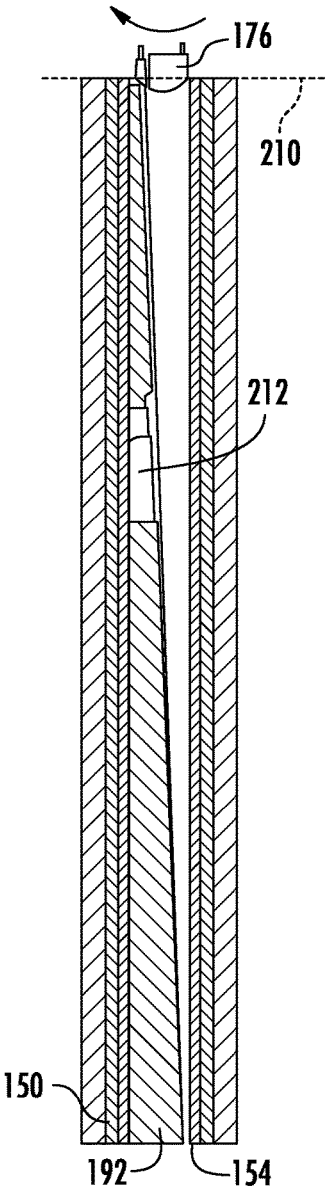
FIGS. 2A-2C illustrates an exemplary sidetrack milling operation, according to certain aspects of the present disclosure.
Figure 2B:
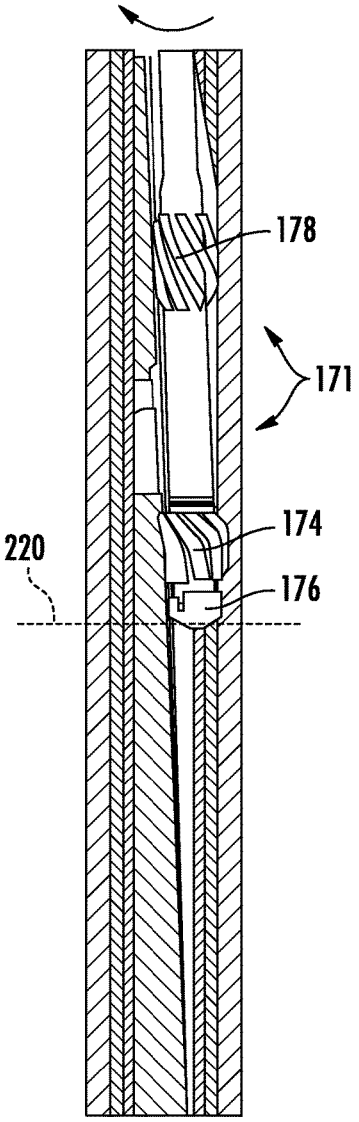
Figure 2C:
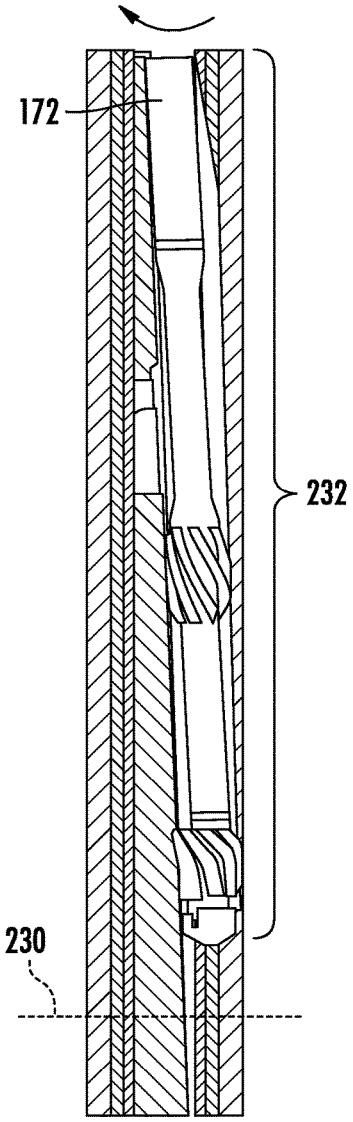

FIGS. 2A-2C illustrate an exemplary sidetrack milling operation conducted using the control system 100, according to another aspect of the present disclosure. FIG. 2A illustrates a pilot mill 176 engaging a top 210 of the whipstock 192. FIG. 2B illustrates the milling operation near a start of a core point 220. FIG. 2C illustrates the milling operation near completion. The BHA 171 may include the lead mill 174, pilot mill 176, drill collars, a trail (i.e., secondary or flex) mill 178, measurement while drilling (MWD) sensors (not shown), logging while drilling (LWD) sensors (not shown), and a float valve (to prevent backflow of fluid from the annulus) or other components not shown, but known to those skilled in the art of milling.

Each lead mill 174, pilot mill 176, and trail mill 178 may include a tubular housing connected to other components of the BHA 171 or to the deployment string 172, such as by a threaded connection. Each lead mill 174, pilot mill 176, and trail mill 178 may further include one or more blades formed or disposed around an outer surface of the tubular housing. Cutters may be disposed along each of the blades, such as by pressing, bonding, or threading. The cutters may be made from a hard material, such as ceramic or cermet (i.e., tungsten carbide) or any other material(s) suitable for milling a window in a wellbore casing.

The mill string 170 may be run into the primary wellbore 150 (see FIG. 1) to a desired depth of the window 232. The whipstock 192 may be oriented within the casing 154 by rotation of the deployment string 172 using MWD sensors in communication with the rig controller 110 (see FIG. 1) via wireless telemetry, such as mud pulse, acoustic, or electromagnetic (EM). Additionally or alternatively, the mill string 170 (see FIG. 1) may be wired or include a pair of conductive paths for transverse communications. The PLC may record an orientation of the whipstock. The anchor 194 (see FIG. 1) may be set with the whipstock 192 at the desired orientation.

The whipstock 192 may include one or more whipstock retrieval slots 212 that may be used to retrieve the whipstock, such as when the sidetrack drilling operation is complete and/or if the whipstock needs to be repositioned.

Example Correction for Drill Pipe Compression

In previously known techniques for milling casing exits (e.g., for sidetrack drilling), current rate of penetration (ROP) of the mill through the casing and cement is determined by movement in surface block height (e.g., as measured at the top drive 158 or draw works 160, see FIG. 1). That is, if the block moves down 1 foot in 15 minutes, then the current ROP is 1 ft*(60 min/hr)/15 min=4 ft/hr. This calculation of the ROP may be inaccurate, because some downward movement of the block at the surface may be solely due to a change in applied weight or force. For example, compression of drill pipe in a drill string may allow the block to move downward, at the surface. Animations of the milling operation (e.g., in a computer system modeling the operation) may show that the mill (e.g., milling bit) is deeper than the mill actually is, which may be very misleading and cause a mistake in judgment by an operator managing the milling operation (e.g., the operator may determine the casing exit is complete, when the mill has not yet fully penetrated the casing).

According to aspects of the present disclosure, measurements may be made of movement of a block while a force is applied to the block (e.g., surface weight-on-bit is increased) and a bottom of a drill string is known to be stationary. For example, during shear-off of a pin holding a whipstock to a drill string, surface weight-on-bit (e.g., a reduction in the measured weight of the drill string supported by the drilling rig) and corresponding block movements, at the surface, may be recorded. This data may be used to determine a mathematical relationship between the surface WOB and the block movement that is specific to the tools and geometry of the drilling rig and wellbore at that time. As weight is adjusted (e.g., WOB is increased because weight of the drill string supported by the drilling rig is reduced) during a downhole operation (e.g., milling a casing exit), this mathematical relationship can be used to calculate error, induced due to drill pipe compression, in the milling feet (i.e., displacement of the mill while milling is occurring) and ROP. A control system incorporating aspects of the present disclosure may remove the error and display a corrected animation of the milling operation.

Previously known techniques have attempted to correct for drill pipe compression by modeling the drill pipe and other components. The compression may then be calculated based on the models and using known inputs, such as torque applied by a top drive motor and surface weight-on-bit. These techniques have not been considered practical, because accuracy of the torque and drag analysis is generally too poor to allow for a sufficiently accurate correction to be made. In some techniques, information regarding behavior of a mill may be captured by instruments located downhole, referred to as downhole subs. The downhole subs may capture data such as torque applied to a milling bit, displacement of the milling bit, and rotational speed of the milling bit. While the use of downhole subs can improve accuracy of a torque and drag analysis of a mill string, the downhole subs increase the expense of the milling operation and can be damaged during the milling operation. A risk-versus-reward analysis may prevent these tools from being run as the added value of good data does not justify the added risk of leaving the tool in the hole and having to retrieve a stuck fish. Damage to a downhole sub during a milling operation may reduce the accuracy of the torque and drag analysis, in which case the milling operation may be stopped and actions taken to repair and/or replace the damaged downhole sub. The actions may include removal of the drill string from the wellbore (e.g., a "trip"), resulting in additional expense and loss of time.

According to aspects of the present disclosure, compression of a drill string (e.g., a work string, a mill string) in a wellbore can be measured by measuring a force (e.g., a reduction in the weight of the drill string being supported by the drilling rig) applied to the drill string while a downhole tool attached to the drill string is stacked on a known solid downhole reference, such as a bridge plug, a whipstock, or a fish. The measured compression of the drill string while the known force is applied can be used to correct for compression of the drill string while milling or other operations are being performed. For example, during a casing exit procedure, a whipstock is positioned in the wellbore by shearing off a connector (e.g., a shear bolt or shear pin) from the mills (i.e., milling bits). In the example, a series of surface WOBs and surface block movements may be recorded during the shearing-off process, such as those shown in Table 1 below.

TABLE 1

| Surface WOB | Block Position | Change in Block Position |
|---|---|---|
| 0 | 32.5 | 0 |
| 5000 | 32 | −0.5 |
| 10000 | 31.6 | −0.9 |
| 15000 | 31 | −1.5 |
| 20000 | 30.6 | −1.9 |
| 25000 | 30 | −2.5 |

In aspects of the present disclosure, measuring of compression of a drill string may be done relatively slowly to prevent a possible time-lag between application of a force (e.g., a surface weight-on-bit resulting from a slack-off operation) and a corresponding change in surface block position. The measured forces and corresponding surface block positions may be displayed as a curve and/or as a well- and tool-specific relationship (e.g., a mathematical equation) describing the change in surface block position associated with an increase or decrease in force (i.e., surface WOB), as shown in FIG. 6.

Figure 6:
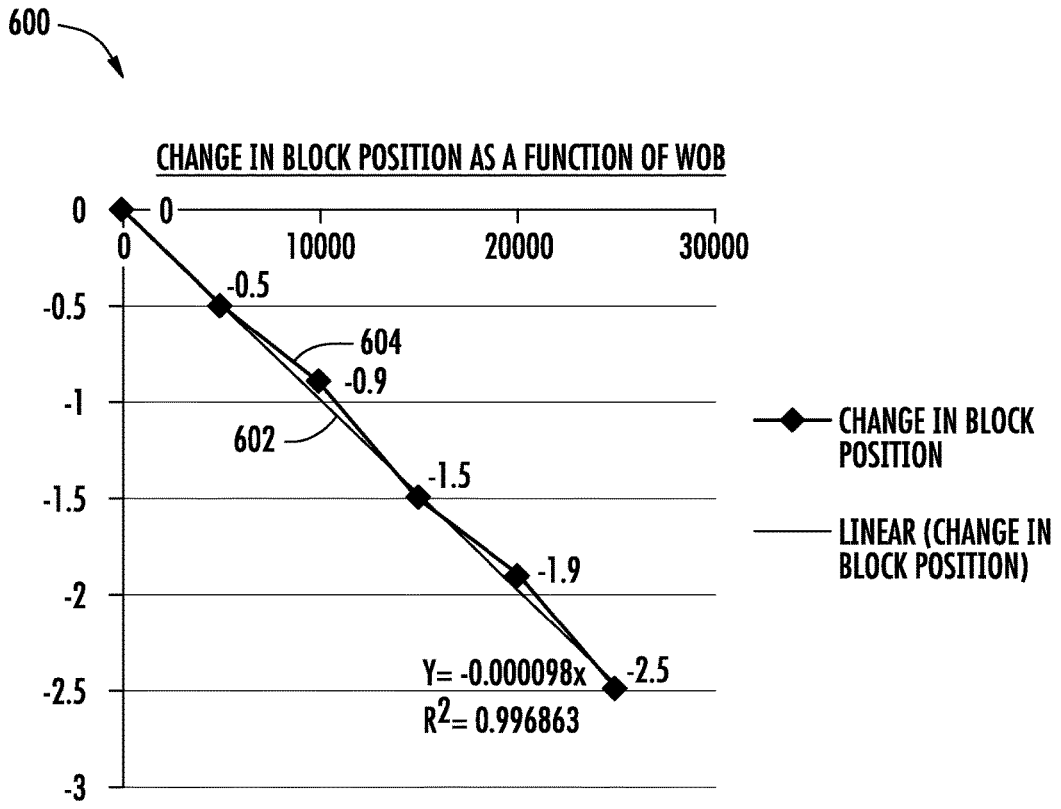
FIG. 6 illustrates data of an exemplary sidetrack milling operation, according to certain aspects of the present disclosure.

In the example graph 600 shown in FIG. 6, an exemplary curve 604 shows a relationship between a surface block position and a force (i.e., surface WOB) indicative of WOB, based on the data shown in Table 1 above. FIG. 6 also shows an exemplary curve fit 602, which is linear with a known error. A control system incorporating aspects of the present disclosure may prompt for additional data samples if the error between the actual data and the curve fit is greater than or equal to a threshold amount. This may prevent the control system from displaying tool (e.g., mill) positions that have large errors. For example, a control system may prompt for additional data samples if an error between actual data and a curve fit of the data is greater than or equal to 0.2 feet.

According to aspects of the present disclosure, an apparent rate of penetration, based on raw data regarding surface weight-on-bit, movement of the block (at the surface), and elapsed time (e.g., time elapsed between times associated with various block positions) can be calculated. The apparent ROP may be referred to as Surface ROP, as shown in the exemplary data in Table 2, below.

TABLE 2

| | Now | 30 seconds previously | |
|---|---|---|---|
| Time | 10:18:32 AM | 10:18:02 AM | |
| Surface WOB | 17250 | 17000 | lbs |
| Actual Block Position | 19.21 | 19.24 | ft |
| Surface block movement | −0.03 | | ft |
| Surface ROP | (3.60) | | ft/hr |

In previously known techniques, the exemplary data set above indicates that the ROP is downward at 3.6 feet per hour. However, the surface WOB was increased, possibly causing the drill string to compress, resulting in this ROP being at least partially based on the surface WOB, instead of being based on true milling gains (i.e., actual movement of the mills resulting from removal of casing material and/or cement). Previously known techniques prompted the service technician to "mill off the weight" back to a previous weight to overcome the uncertainty of drill pipe compression, which reduces speed at which the mills are milling the window, thus reducing the effectiveness of the operation and prompting the development of downhole telemetry equipment.

According to aspects of the present disclosure, the surface WOB in the exemplary data set can be converted into a drill string compression using the data and/or relationship from the measurements made of the drill string compression (e.g., measurements made during a shear-off procedure), such as those above, when a positive downhole reference is available. The relationship calculated from the exemplary measurements of drill string compression implies that the drill string should have compressed 0.0245 feet due to the increased 250 pounds apparently applied to the BHA (i.e., surface WOB increased by 250 pounds). The compression of the drill string resulting from the increased weight means that although the apparent ROP (e.g., Surface ROP) is 3.6 ft/hr, the actual ROP is only a fraction of that number, specifically 0.66 ft/hr in this example. Table 3 below shows data relating to the correction. Specifically, the table shows the change in applied weight (e.g., surface WOB) of 250 lbs, the drill string compression of −0.0245 ft (calculated based on the previously measured compression of the drill string), the corrected downhole tool movement of −0.0055 ft (calculated by subtracting the drill string compression of −0.0245 ft from the surface block movement of −0.03 ft), and the corrected downhole ROP of 0.66 ft/hr (calculated by dividing the corrected downhole tool movement of −0.0055 ft by the elapsed time of 30 seconds=0.00833 hr).

TABLE 3

| | | |
|---|---|---|
| Change in applied weight | 250 | Lbs |
| Drill string compression | −0.0245 | Ft |
| Corrected downhole tool movement | −0.0055 | Ft |
| Corrected downhole ROP | (0.66) | Ft/hr |

According to aspects of the present disclosure, small errors, such as those shown in the exemplary data above, may add up to a large discrepancy in the apparent mill position. The small errors in the mill position can be corrected by using an algorithm based on the curve relating the surface WOB to the drill string compression, also referred to as a calibration curve. An algorithm incorporating aspects of the present disclosure may be described as follows: 1) With the surface WOB and calibration curve known, the drill string compression is calculated. 2) Then, from the drop in block height at the surface from the start of milling, the "surface milling feet" is known. 3) A "corrected milling feet, downhole," representing an actual number of feet milled downhole, is then determined from addition of the surface milling feet and the drill string compression determined from the surface WOB, as shown in the exemplary data in Table 4 below.

TABLE 4

| | |
|---|---|
| WOB | 17250 lbs |
| Drill string compression | −1.6905 ft |
| Milling Feet, Surface | 13.6 ft |
| Corrected Milling Feet, downhole | 11.9095 ft |

Figure 3:
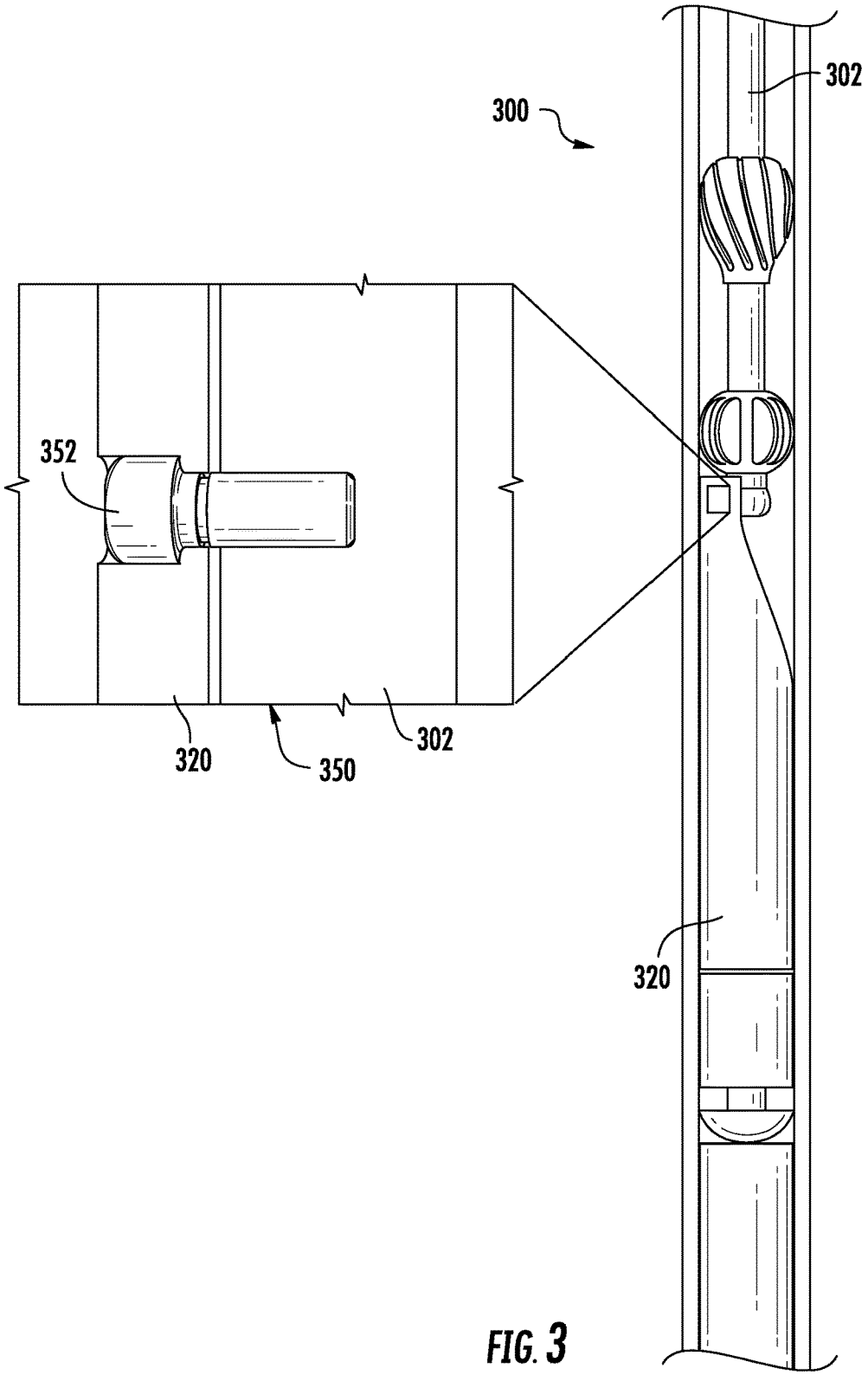
FIG. 3 illustrates an exemplary wellbore, according to certain aspects of the present disclosure.

FIG. 3 shows an exemplary wellbore 300, according to aspects of the present disclosure. An exemplary milling bit 302 and an exemplary whipstock 320 are in the wellbore, positioned as the milling bit and the whipstock would be shortly before the whipstock is set in the wellbore. As can be seen by the cut-away shown in detail at 350, the milling bit and the whipstock are connected by a shear pin 352. During a shear-off operation, weight of the drill string supported by the drilling rig is reduced (e.g., surface weight-on-bit is increased) while the bottom of the drill string (e.g., the whipstock 320) is stationary. The surface WOB may be increased (e.g., weight supported by the drilling rig decreased) until the shear pin breaks (e.g., shears), with the portion of the weight of the drill string not supported by the drilling rig causing the whipstock to be set. While the surface WOB is being increased, displacement of the top of the drill string (e.g., the block) may be measured to determine the calibration curve, as mentioned above. There are multiple ways to achieve a stationary reference for a drill string that may be used in determining a relationship between surface WOB and downhole movement, as described herein.

Figure 4A:
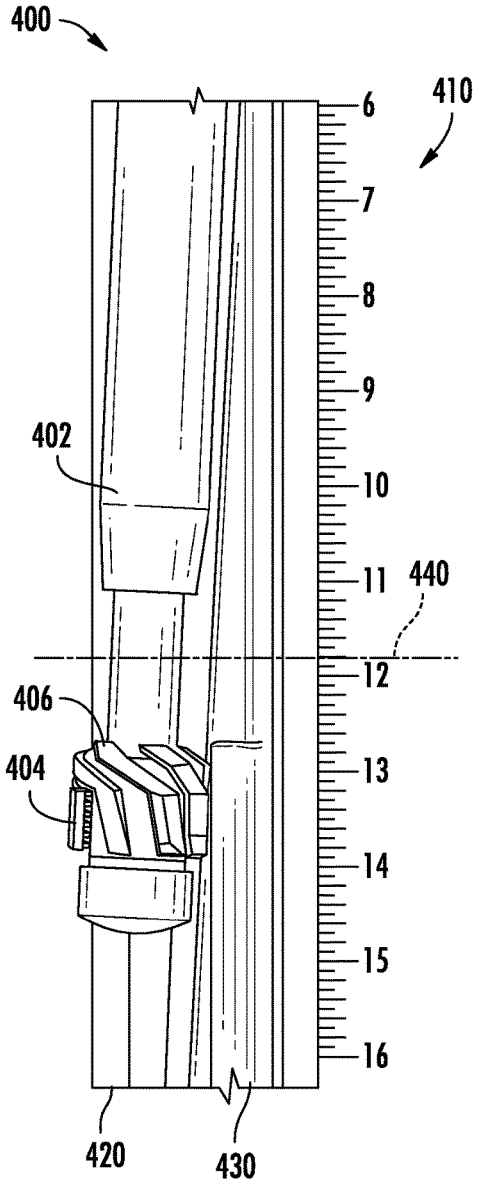
FIGS. 4A & 4B illustrate an exemplary milling operation, according to certain aspects of the present disclosure.
Figure 4B:
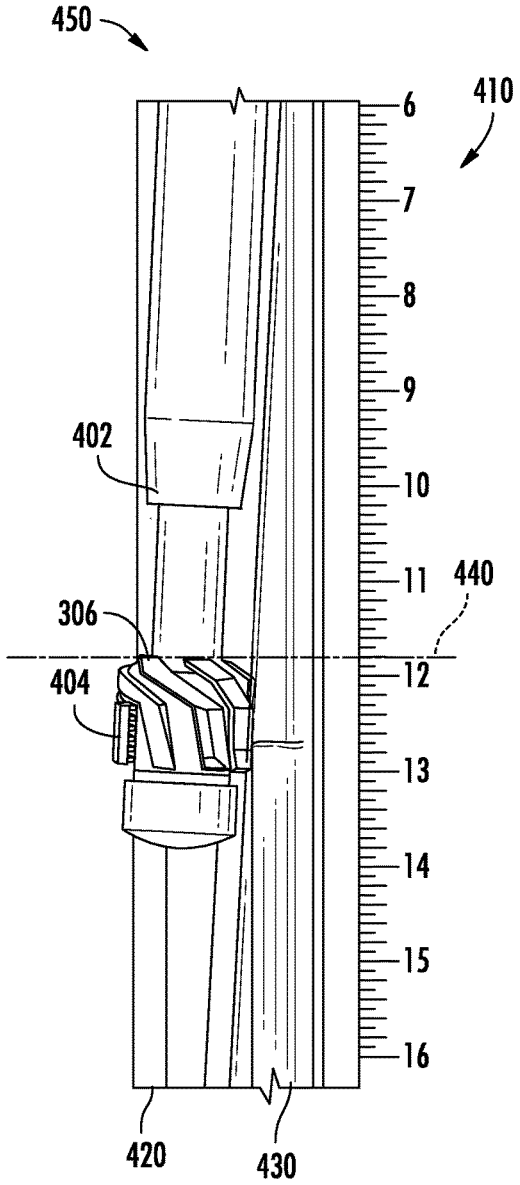

FIG. 4A shows an image 400 from an animation of a milling operation, wherein the animation displayed images based on movement of the block at the surface, as mentioned above and according to previously known techniques. FIG. 4B shows an image 450 from an animation of the same milling operation, wherein the animation displayed images based on a control system that is an aspect of the present disclosure.

The image 400 in FIG. 4A includes portions of a milling bit 402, a whipstock 430, and of casing 420. The scales shown at 410 are in feet, and measure the distance from a top of the whipstock.

The image 450 in FIG. 4B also includes portions of the milling bit 402, the whipstock 430, and the casing 420.

As can be seen in FIG. 4A, the animation displaying images based on movement of the block at the surface, according to previously known techniques, shows the trailing edge 406 of the lead mill 404 at a position 12.7 ft below the top of the whipstock.

As can be seen in FIG. 4B, the animation displaying images based on a control system that is an aspect of the present disclosure shows the trailing edge 406 of the lead mill 404 at a position 11.8 ft below the top of the whipstock. The animation according to previously known techniques shows the milling bit at a position 0.9 ft below the milling bit's actual position, as can be seen with reference to the line at 440. An operator relying on the animation represented by the image 400 in FIG. 4A might conclude the casing exit (i.e., the hole being milled in the casing) is complete, when in actuality the casing exit is incomplete, because the mill is almost 1 ft higher than the position shown in the animation.

Figure 5:
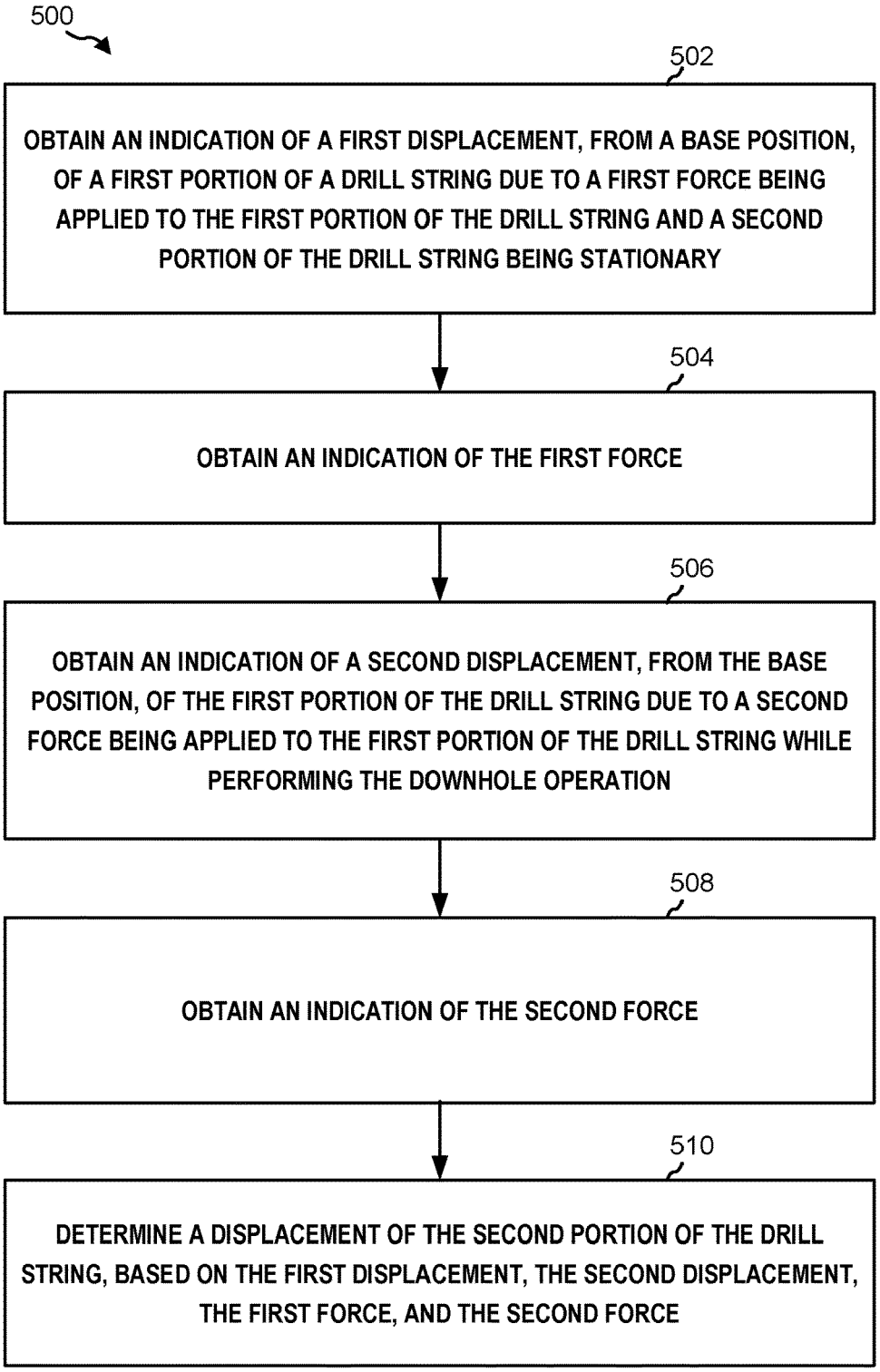
FIG. 5 is a flow diagram of exemplary operations for milling a casing in a wellbore, according to certain aspects of the present disclosure.

FIG. 5 is a flow diagram of example operations 500 for controlling a downhole operation in a wellbore, according to certain aspects of the present disclosure. The operations 500 may be performed using a control system for working in a wellbore, such as the control system 100 shown in FIG. 1.

The operations 500 may begin at block 502 by obtaining an indication of a first displacement, from a base position, of a first portion of a drill string due to a first force being applied to the first portion of the drill string and a second portion of the drill string being stationary. For example, the control system 100 may obtain an indication (e.g., from a position sensor monitoring the block at the surface) that the top of the drill string has moved down 1.5 ft, as in the fourth row of Table 1.

At block 504, operations 500 continue with obtaining an indication of the first force. For example, the first force may be a force applied by a drilling rig (e.g., a top drive) to support a portion of the weight of the drill string, and the indication may be a measurement of a reduction from another force applied by the top drive when the top drive is supporting the entire weight of the drill string. Continuing the example from above, the control system may obtain an indication (e.g., from a load cell monitoring the block at the surface) that a force 15000 lbs less than a force sufficient to support the entire weight of the drill string is being applied to the top of the drill string (e.g., surface WOB is 15000 lbs), as shown in the fourth row of Table 1. In the example, the surface WOB may be 15000 lbs, because a slack-off operation of the drilling rig has allowed the drill string (e.g., a BHA) to support a portion of the weight of the drill string.

Operations 500 continue at block 506 with obtaining an indication of a second displacement, from the base position, of the first portion of the drill string due to a second force being applied to the first portion of the drill string while performing the downhole operation. Continuing the example, the control system may obtain an indication that the top of the drill string has moved down to a block height of 13.6 ft, as shown in Table 4, while milling the casing, with a mill bit attached to the drill string. In the example, one or more other slacking-off operations may have occurred to allow the top of the drill string to move down the 13.6 ft. The other slacking-off operations may cause the upward force partially supporting the weight of the drill string to change (i.e., to a second force), also possibly changing the surface WOB.

At block 508, operations 500 continue with obtaining an indication of the second force. Continuing the example, the control system may obtain an indication that a force 17250 lbs less than a force sufficient to support the entire weight of the drill string (e.g., surface WOB is 17250 lbs) is being applied to the top of the drill string while milling the casing.

Operations 500 may conclude at block 510 with determining a displacement of the second portion of the drill string, based on the first displacement, the second displacement, the first force, and the second force. Continuing the example from above, the control system may determine that a displacement of the mill is 11.9095 ft, as shown in Table 4, based on the first displacement of 1.5 ft, the second displacement of 13.6 ft, the first force that is 15000 lbs less than a force sufficient to support the entire weight of the drill string (e.g., surface WOB is 15000 lbs), and the second force that is 17250 lbs less than the force sufficient to support the entire weight of the drill string (e.g., surface WOB is 17250 lbs).

The first portion of the drill string in FIG. 5 may be a top (end) of the drill string, and the second portion in FIG. 5 may be a bottom (end) of the drill string. Additionally or alternatively, the first portion of the drill string in FIG. 5 may be a portion of the drill string proximal to a drilling rig, and the second portion of the drill string in FIG. 5 may be a distal end of the drill string, where work (e.g., milling or drilling) is being performed by the drill string.

According to aspects of the present disclosure, a control system may cease milling a casing, based on a determined displacement of a mill. Continuing the example from above, the control system may cease or take action to cease milling the casing, based on the determined displacement of the mill of 11.9095 ft equaling a desired milling feet of 11.9095 ft. In the example, if the desired milling feet is 13.6 ft, then the control system may not cease or take action to cease milling the case, despite the surface milling feet (see Table 4) being equal to 13.6 ft. Ceasing milling the casing may comprise stopping rotation of the drill string (e.g., drill string 170) or raising the drill string so that the lead mill, pilot mill, and trail mill are no longer in contact with the casing. Taking action to cease milling may include sending commands or other control signals to other devices (e.g., a top drive 158, shown in FIG. 1) to stop rotation of the drill string and/or to raise the drill string. Taking action to cease milling may also include outputting an indication (e.g., an alert message on a display) that milling the casing should be ceased.

In aspects of the present disclosure, a rate of penetration (ROP) of the casing may be calculated based on an indication of an elapsed time between commencing milling of the casing and a time associated with determining the displacement of the mill (e.g., as described above with reference to block 510 of FIG. 5). Continuing the example from above, if time elapsed between commencing of milling the casing and determining the displacement of the mill is fifteen hours, then the ROP is 11.9095 ft divided by 15 hrs, or 0.793967 ft/hr.

According to aspects of the present disclosure, a short-term ROP of the casing milling operation may be calculated based on a first determined displacement (e.g., a displacement determined while taking into account changes in surface WOB, as described above with reference to FIG. 5) of the mill, a first time associated with the first determined displacement of the mill, a second determined displacement (e.g. a displacement determined while taking into account changes in surface WOB, as described above with reference to FIG. 5) of the mill, and a second time associated with the second determined displacement of the mill. For example, if a first determined displacement of the mill is 11.210 ft, a first time associated with the first displacement is 10:18:30 a.m., a second determined displacement of the mill is 11.215 ft, and a second time associated with the second determined displacement is 10:19:00 a.m., then a short-term ROP of the casing may be calculated as (11.215 ft-11.210 ft)/(30 secs) *(3600 sec/hr)=0.6 ft/hr.

It is understood that the specific order or hierarchy of steps in the processes disclosed above is an illustration of exemplary approaches. Based upon design preferences, it is understood that the specific order or hierarchy of steps in the processes may be rearranged. Further, some steps may be combined or omitted. The accompanying method claims present elements of the various steps in a sample order, and are not meant to be limited to the specific order or hierarchy presented.

The various operations of methods described above may be performed by any suitable means capable of performing the corresponding functions. The means may include various hardware and/or software component(s) and/or module(s), including, but not limited to a circuit, an application specific integrated circuit (ASIC), or a processor.

The various illustrative logical blocks, modules and circuits described in connection with the present disclosure may be implemented or performed with a general purpose processor, an application specific integrated circuit (ASIC), a field programmable gate array (FPGA) or other programmable logic device (PLD), or any combination thereof designed to perform the functions described herein. A processor may be implemented as a combination of computing devices, e.g., a combination of an ASIC and a microprocessor, a plurality of microprocessors, or any other such configuration.

If implemented in software, the functions may be stored or transmitted as one or more instructions or code on a computer-readable medium. A spreadsheet, as illustrated in Tables 1-4 herein, may be an example of an implementation of aspects of the present disclosure in software. Software shall be construed broadly to mean instructions, data, or any combination thereof, whether referred to as software, firmware, middleware, microcode, hardware description language, or otherwise. Computer-readable media include both computer storage media and communication media including any medium that facilitates transfer of a computer program from one place to another. The processor may be responsible for managing a bus and general processing, including the execution of software modules stored on the machine-readable storage media. A computer-readable storage medium may be coupled to a processor such that the processor can read information from, and write information to, the storage medium. In the alternative, the storage medium may be integral to the processor. Alternatively, or in addition, the machine-readable media, or any portion thereof, may be integrated into the processor, such as the case may be with cache and/or general register files. Examples of machine-readable storage media may include, by way of example, RAM (Random Access Memory), flash memory, ROM (Read Only Memory), PROM (Programmable Read-Only Memory), EPROM (Erasable Programmable Read-Only Memory), EEPROM (Electrically Erasable Programmable Read-Only Memory), registers, magnetic disks, optical disks, hard drives, or any other suitable storage medium, or any combination thereof.

A software module may comprise a single instruction, or many instructions, and may be distributed over several different code segments, among different programs, and across multiple storage media. The computer-readable media may comprise a number of software modules. The software modules include instructions that, when executed by an apparatus such as a processor, cause the processing system to perform various functions. The software modules may include a transmission module and a receiving module. Each software module may reside in a single storage device or be distributed across multiple storage devices. By way of example, a software module may be loaded into RAM from a hard drive when a triggering event occurs. During execution of the software module, the processor may load some of the instructions into cache to increase access speed. One or more cache lines may then be loaded into a general register file for execution by the processor. When referring to the functionality of a software module below, it will be understood that such functionality is implemented by the processor when executing instructions from that software module.

Also, any connection is properly termed a computer-readable medium. For example, if the software is transmitted from a website, server, or other remote source using a coaxial cable, fiber optic cable, twisted pair, digital subscriber line (DSL), or wireless technologies such as infrared (IR), radio, and microwave, then the coaxial cable, fiber optic cable, twisted pair, DSL, or wireless technologies such as infrared, radio, and microwave are included in the definition of medium. Disk and disc, as used herein, include compact disc (CD), laser disc, optical disc, digital versatile disc (DVD), floppy disk, and Blu-ray® disc where disks usually reproduce data magnetically, while discs reproduce data optically with lasers. Thus, in some aspects computer-readable media may comprise non-transitory computer-readable media (e.g., tangible media). In addition, for other aspects computer-readable media may comprise transitory computer-readable media (e.g., a signal) and/or manual data entry. Combinations of the above should also be included within the scope of computer-readable media.

Thus, certain aspects may comprise a computer program product for performing the operations presented herein. For example, such a computer program product may comprise a computer-readable medium having instructions stored (and/or encoded) thereon, the instructions being executable by one or more processors to perform the operations described herein.

Further, it should be appreciated that modules and/or other appropriate means for performing the methods and techniques described herein can be downloaded and/or otherwise obtained by a computer as applicable. For example, a computer can be coupled to a server to facilitate the transfer of means for performing the methods described herein. Alternatively, various methods described herein can be provided via storage means (e.g., RAM, ROM, a physical storage medium such as a compact disc (CD) or floppy disk, etc.), such that a computer can obtain the various methods upon coupling or providing the storage means to the computer. Moreover, any other suitable technique for providing the methods and techniques described herein to a computer can be utilized.

Moreover, the term "or" is intended to mean an inclusive "or" rather than an exclusive "or." For example, unless specified otherwise or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. A phrase referring to "at least one of" a list of items refers to any combination of those items, including single members. As an example, "at least one of: a, b, or c" is intended to cover: a, b, c, a-b, a-c, b-c, and a-b-c.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims.

While the foregoing is directed to aspects of the present disclosure, other and further aspects of the disclosure may be devised without departing from the basic scope thereof, and the scope thereof is determined by the claims that follow.

The invention claimed is:

1. A method for controlling a downhole operation in a wellbore, comprising:

obtaining an indication of a first displacement, from a base position, of a first portion of a drill string due to a first force being applied to the first portion of the drill string and a second portion of the drill string being stationary;

obtaining an indication of the first force;

obtaining an indication of a second displacement, from the base position, of the first portion of the drill string due to a second force being applied to the first portion of the drill string while performing the downhole operation;

obtaining an indication of the second force; and determining a displacement of the second portion of the drill string, based on the first displacement, the second displacement, the first force, and the second force.

2. The method of claim 1, wherein:

the downhole operation comprises milling a casing in the wellbore with a mill attached to the drill string, and determining the displacement of the second portion of the drill string comprises determining a displacement of the mill.

3. The method of claim 2, further comprising:

determining a depth of penetration of the casing, based on the displacement of the mill.

4. The method of claim 2, further comprising:

causing the milling of the casing to cease, based on the determined displacement of the mill.

5. The method of claim 2, further comprising:

obtaining an indication of an elapsed time between a commencement of milling the casing and a time associated with the displacement of the mill; and determining a rate of penetration (ROP) of the casing based on the displacement of the mill and the elapsed time.

6. The method of claim 5, further comprising:

plotting the displacement of the mill and the ROP on respective graphs.

7. The method of claim 5, further comprising:

displaying an animation of the milling of the casing while the milling of the casing is ongoing, wherein the animation is based on the displacement of the mill and the elapsed time.

8. The method of claim 2, further comprising:

obtaining an indication of a third displacement, from the base position, of the first portion of the drill string due to a third force being applied to the first portion of the drill string while milling the casing;

obtaining an indication of the third force; and determining another displacement of the mill based on the third displacement and the third force.

9. The method of claim 8, further comprising:

obtaining an indication of an elapsed time between a time associated with the other displacement of the mill and a time associated with the displacement of the mill; and determining a rate of penetration (ROP) of the casing based on the displacement of the mill, the other displacement of the mill, and the elapsed time.

10. The method of claim 1, further comprising:

obtaining an indication of a third displacement, from the base position, of the first portion of the drill string due to a third force being applied to the first portion of the drill string and the second portion of the drill string being stationary; and obtaining an indication of the third force, wherein the determining comprises determining the displacement of the second portion of the drill string further based on the third displacement and the third force.

11. The method of claim 1, wherein:

a whipstock is disposed in the wellbore, and a whipstock setting procedure is used to cause the second portion of the drill string to be stationary while the first force is applied to the first portion of the drill string.

12. The method of claim 1, wherein at least one of the indication of the first force or the indication of the second force comprises an indication of a weight-on-bit (WOB) of the drill string.

13. The method of claim 1, wherein:

the first portion of the drill string comprises a top of the drill string; and the second portion of the drill string comprises a bottom of the drill string.

14. An apparatus for controlling a downhole operation in a wellbore, comprising:

a processing system configured to:

obtain an indication of a first displacement, from a base position, of a first portion of a drill string due to a first force being applied to the first portion of the drill string and a second portion of the drill string being stationary;

obtain an indication of the first force;

obtain an indication of a second displacement, from the base position, of the first portion of the drill string due to a second force being applied to the first portion of the drill string while performing the downhole operation;

obtain an indication of the second force; and determine a displacement of the second portion of the drill string, based on the first displacement, the second displacement, the first force, and the second force; and a memory coupled with the processing system.

15. The apparatus of claim 14, wherein:

the downhole operation comprises milling a casing in the wellbore with a mill attached to the drill string; and the processing system is configured to determine the displacement of the second portion of the drill string by determining a displacement of the mill.

16. The apparatus of claim 15, wherein the processing system is further configured to:

determine a depth of penetration of the casing, based on the displacement of the mill.

17. The apparatus of claim 15, wherein the processing system is further configured to:

obtain an indication of an elapsed time between a commencement of milling the casing and a time associated with the displacement of the mill; and determine a rate of penetration (ROP) of the casing based on the displacement of the mill and the elapsed time.

18. The apparatus of claim 17, wherein the processing system is further configured to:

cause plotting of the displacement of the mill and the ROP on respective graphs.

19. The apparatus of claim 17, wherein the processing system is further configured to:

cause display of an animation of the milling of the casing while the milling of the casing is ongoing, wherein the animation is based on the displacement of the mill and the elapsed time.

20. The apparatus of claim 15, wherein the processing system is further configured to:

obtain an indication of a third displacement, from the base position, of the first portion of the drill string due to a third force being applied to the first portion of the drill string while milling the casing;

obtain an indication of the third force; and determine another displacement of the mill based on the third displacement and the third force.

21. The apparatus of claim 20, wherein the processing system is further configured to:

obtain an indication of an elapsed time between a time associated with the other displacement of the mill and a time associated with the displacement of the mill; and determine a rate of penetration (ROP) of the casing based on the displacement of the mill, the other displacement of the mill, and the elapsed time.

22. The apparatus of claim 14, wherein the processing system is further configured to:

obtain an indication of a third displacement, from the base position, of the first portion of the drill string due to a third force being applied to the first portion of the drill string and the second portion of the drill string being stationary; and obtain an indication of the third force, wherein the processing system is configured to determine the displacement of the second portion of the drill string further based on the third displacement and the third force.

23. A non-transitory computer-readable medium containing a program which, when executed by a processing system, causes the processing system to perform operations comprising:

obtaining an indication of a first displacement, from a base position, of a first portion of a drill string due to a first force being applied to the first portion of the drill string and a second portion of the drill string being stationary;

obtaining an indication of the first force;

obtaining an indication of a second displacement, from the base position, of the first portion of the drill string due to a second force being applied to the first portion of the drill string while performing a downhole operation;

obtaining an indication of the second force; and determining a displacement of the second portion of the drill string, based on the first displacement, the second displacement, the first force, and the second force.

24. The computer-readable medium of claim 23, wherein:

the downhole operation comprises milling a casing in a wellbore with a mill attached to the drill string; and determining the displacement of the second portion of the drill string comprises determining a displacement of the mill.

25. The computer-readable medium of claim 24, wherein the operations further comprise:

determining a depth of penetration of the casing, based on the displacement of the mill.

26. The computer-readable medium of claim 24, wherein the operations further comprise:

obtaining an indication of an elapsed time between a commencement of milling the casing and a time associated with the displacement of the mill; and determining a rate of penetration (ROP) of the casing based on the displacement of the mill and the elapsed time.

27. The computer-readable medium of claim 26, wherein the operations further comprise:

plotting the displacement of the mill and the ROP on respective graphs.

28. The computer-readable medium of claim 26, wherein the operations further comprise:

displaying an animation of the milling of the casing while the milling of the casing is ongoing, wherein the animation is based on the displacement of the mill and the elapsed time.

29. The computer-readable medium of claim 24, wherein the operations further comprise:

obtaining an indication of a third displacement, from the base position, of the first portion of the drill string due to a third force being applied to the first portion of the drill string while milling the casing;

obtaining an indication of the third force; and determining another displacement of the mill based on the third displacement and the third force.

30. The computer-readable medium of claim 29, wherein the operations further comprise:

obtaining an indication of an elapsed time between a time associated with the other displacement of the mill and a time associated with the displacement of the mill; and determining a rate of penetration (ROP) of the casing based on the displacement of the mill, the other displacement of the mill, and the elapsed time.

* * * * *